United States Patent [19]

Sullivan

[11] 4,419,773

[45] Dec. 13, 1983

[54] ADJUSTABLE TANK DISCHARGE VALVE FOR CONTROLLING FLUSH WATER VOLUME

[76] Inventor: Donald E. Sullivan, 1493 Fahlander Dr. S., Columbus, Ohio 43229

[21] Appl. No.: 357,731

[22] Filed: Mar. 12, 1982

[51] Int. Cl.[3] ..... E03D 1/34

[52] U.S. Cl. ..... 4/392; 4/395; 137/403; 137/427

[58] Field of Search ..... 4/381, 391–393, 4/395–397; 137/403, 404, 427; 251/48

[56] References Cited

U.S. PATENT DOCUMENTS

| | | | |
|---|---|---|---|
| 2,598,967 | 6/1952 | Bennett . | |
| 2,741,775 | 4/1956 | Schmidt . | |
| 3,733,618 | 5/1973 | Wiagand . | |
| 3,935,598 | 2/1976 | Schmidt . | |
| 3,955,218 | 5/1976 | Ramsey . | |
| 3,969,775 | 7/1976 | Hazelton . | |
| 4,000,526 | 1/1977 | Biela et al. | 4/393 X |
| 4,028,748 | 6/1977 | Schoepe et al. . | |
| 4,145,774 | 3/1979 | Sullivan | 4/325 |
| 4,189,795 | 2/1980 | Conti et al. | 4/324 |

*Primary Examiner*—Charles E. Phillips
*Attorney, Agent, or Firm*—Frank H. Foster

[57] ABSTRACT

A discharge valve closure of the type which has a bleeder port to permit the conservation of water by causing the closure to shut the discharge valve prior to the draining of all water from the water tank. The discharge valve closure features an adjustment which permits at least a portion of the buoyancy chamber to be pivoted about the axis of the closure to position the bleeder port at a selected angular spacing from its top dead center position. This adjustment allows the tank water level at which the closure shuts off the discharge valve to be adjusted.

15 Claims, 11 Drawing Figures

ADJUSTABLE TANK DISCHARGE VALVE FOR CONTROLLING FLUSH WATER VOLUME

FIELD OF THE INVENTION

This invention relates to discharge valve closures for use in the water tank of a water closet or toilet fixture and more particularly relates to discharge valve closures of the type providing a flush of reduced water volume for conserving water.

BACKGROUND ART

Water has become increasingly recognized as an important natural resource of limited availability in some geographical areas making conservation measures desirable.

The conventional water closet includes a water storage tank, a waste receipt bowl and passageways for creating siphoning or jet action by the rapid release of water from the water storage tank. Traditionally such water closets have been designed to empty the entire contents of the water tank each time the flushing actuator is operated. However, it is now known that less than the entire water contents of the tank is needed to adequately purge the waste receiving bowl of liquid wastes and refill it with clean water. Usually, however, the entire water content of the tank is needed for removal of solid wastes.

A large variety of devices have been suggested for conserving water in the flushing operation. Some, such as the device illustrated in my earlier U.S. Pat. No. 4,145,774, have two selectable modes of operation. In one mode a flush is initiated which utilizes all of the water in the tank. In the other mode a flush is initiated which uses only part of the stored water. Other types of devices have only one mode of operation in which less than the entire tank volume is utilized.

One popular type of discharge valve closure is the type shown in U.S. Pat. No. 4,028,748. It has a unitary molded body forming the sealing portion, which sealingly engages the valve seat of the discharge valve, and a buoyancy chamber which extends downwardly and has a drain hole at the bottom. When such a conventional discharge valve closure is in the closed position, water drains from the buoyancy chamber. When the valve is lifted by operation of the actuating arm, it is buoyant and remains raised with the valve open until the water level lowers below the discharge valve thereupon permitting the discharge valve to fall by gravity back into the closed position upon the valve seat.

Similar operation is obtained by the valves shown in U.S. Pat. Nos. 2,741,775 and 2,598,967. These devices have no buoyancy chamber but instead rely upon a lightweight foam material for buoyancy.

Other inventors discovered that the conventional discharge closure of the type having a buoyancy chamber can be made to close prematurely, that is before the water level falls below the level of the discharge valve closure, by providing a smalll bleeder port in the buoyancy chamber above or below the sealing portion of the discharge valve closure. In those with the bleeder port above the seal, a snorkle extends upwardly above the water surface level of the filled tank.

In those with a bleeder hole below the seal, preferably the bleeder hole is formed so that it will be facing upwardly when the discharge valve closure is raised to its full open position.

These structures permit the escape of air from the buoyancy chamber so that water may enter the chamber and reduce the buoyancy of the closure to the point that the valve will fall closed before the entire tank contents has been exhausted through the discharge valve. Such structures are shown in U.S. Pat. Nos. 3,935,598; 3,969,775; 4,000,526; and 4,189,795.

Some of these types of devices permit no adjustment for controllably varying the rate of water inlet which determines the rate of change of the buoyancy of the closure and therefore determines the water level at which the discharge valve will fall closed. One device provides a float arrangement attached to the valve for adjustment purposes. Still others provide adjustment by a variety of structures for varying the orifice size by a type of a manually adjustable valve means. Others change the orifice size by providing a plurality of interchangeable inserts having orifices of different sizes. Ordinarily the size of the bottom drain hole is adjusted in the prior art units.

My prior U.S. Pat. No. 4,145,774 utilized a buoyancy chamber with a bleeder hole system but combined it with a unique bistable handle to give improved modes of operation.

It is desirable that an adjustment be provided for the discharge valve closures having a bleeder port in order to permit the adjustable selection of the water level at which the discharge valve closure will prematurely close. Such adjustment is desirable to compensate for variations in the tank structures of different toilet manufacturers, to compensate for the different needs of different sewage and water systems and to permit the owner to select the water volume which the owner desires to utilize when obtaining a reduced water volume flush.

However, the adjustment systems which have previously been suggested are difficult to adjust especially for peopel of limited dexterity or mechanical ability and are subject to the deposit of minerals and other materials which interfere with their operation. Additionally, it is not only more difficult for the owner but more expensive for the manufacturer to provide a plurality of interchangeable orifices or an adjustable orifice valve. Finally, orifices which are adjustable in size are more sensitive to the effect of deposition of materials which will further constrict the size of the orifice.

There is therefore a need for a discharge valve closure which can be adjusted for selection of the desired water level at which the valve will close which is simple, inexpensive and easy to manufacture and yet which does not require interchangeable parts or adjustable valves for adjusting the size of the orifices.

BRIEF SUMMARY OF THE INVENTION

In the present invention the adjustment is accomplished by simply pivoting at least a portion of the discharge valve closure with respect to its mounting arm member to cause the angular position of the bleeder port to be varied to a position away from the top dead center position. This rotation moves the bleeder port away from its highest point when in the open position to a more sideward position to adjustably increase the buoyancy of the discharge valve closure as a function of the sideward positioning of the bleeder port.

This simple, manual, rotatable adjustment requires no interchange of parts, has no valves to become clogged or stuck and can be easily manipulated by most individuals. Additionally, it can preferably be pivoted far enough that the bleeder hole can be positioned 180° opposite from its top dead center position so that the discharge valve closure will then operate essentially identically to a conventional discharge valve closure which retains its buoyancy until essentially all the water has been exhausted from the tank.

Figure 1:
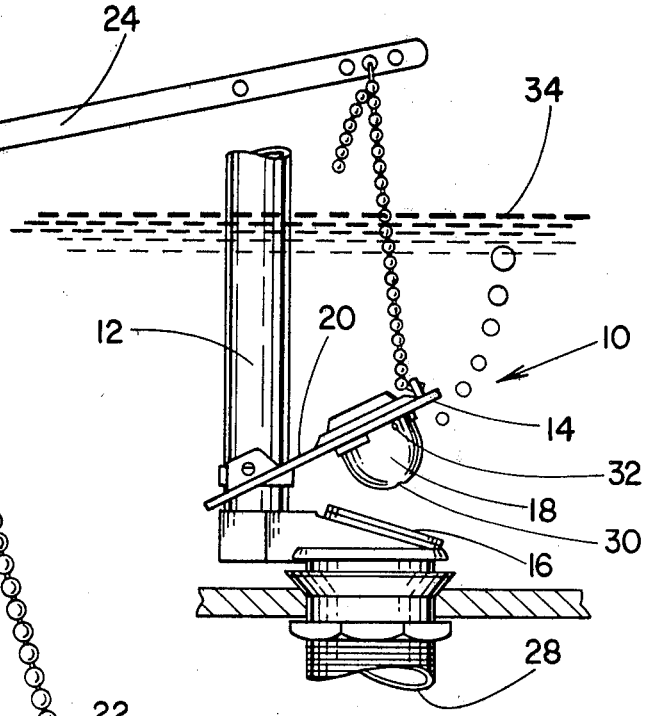
FIG. 1 is a view in side elevation showing a discharge valve embodying the invention and mounted in the water tank in association with its cooperating valve seat and exhaust drain and linked to an operating handle and lever.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION OF THE PREFERRED EMBODIMENT

FIG. 1 illustrates the discharge valve closure 10 mounted in a water tank and directly connected to an overflow tube 12 for pivotal movement. Its annular sealing portion 14 sealingly engages the valve seat 16 when the entire discharge valve closure 10 pivots downwardly. The discharge valve closure 10 also has a buoyancy chamber portion 18 extending downwardly from it and a mounting arm member 20 connected to the overflow tube 12.

The discharge valve closure 10 is linked through a conventional chain 22 to a lever arm 24 which is fixed to a pivot extending through the wall of the water tank (not shown) into connection with the actuating flush handle 26. The lever and flush handle arrangement may be of the conventional type or alternatively may be the type described in my U.S. Pat. No. 4,145,774. In either case, depression of the end of the handle 26 raises the discharge valve closure 10 to permit the water to begin flowing out through the discharge drain 28.

The buoyancy chamber 18 is provided with a drain hole 30 in its bottom and a small bleeder hole 32 relatively higher than the drain hole 30 and formed through the wall of the buoyancy chamber below the sealing portion 14.

With a conventional lever arm 24 and handle 26 a full flush utilizing all of the water in the tank is accomplished by depressing the handle 26 and holding it down until all of the water has exhausted from the water tank. The handle is then released and the discharge valve closure falls closed to permit the tank to refill.

A short or reduced water volume flush is accomplished by depressing the conventional handle 26 and then releasing it permitting the lever 24 to fall downwardly. Then, as the water level 34 falls, water enters the buoyancy chamber 18 through the drain hole 30 as air bubbles upwardly from the bleeder hole 32.

When the net buoyancy of the discharge valve closure and any remaining trapped air becomes negative, the discharge valve closure falls into sealing engagement against the valve seat 16.

If the handle and lever arm are as disclosed in my U.S. Pat. No. 4,145,774, a full flush utilizing all of the water in the tank is accomplished by depressing the handle 26 and releasing it so that it remains biased in its upper bistable position. In order to accomplish a reduced water volume flush, the actuating handle is immediately raised after being depressed.

Figure 2:
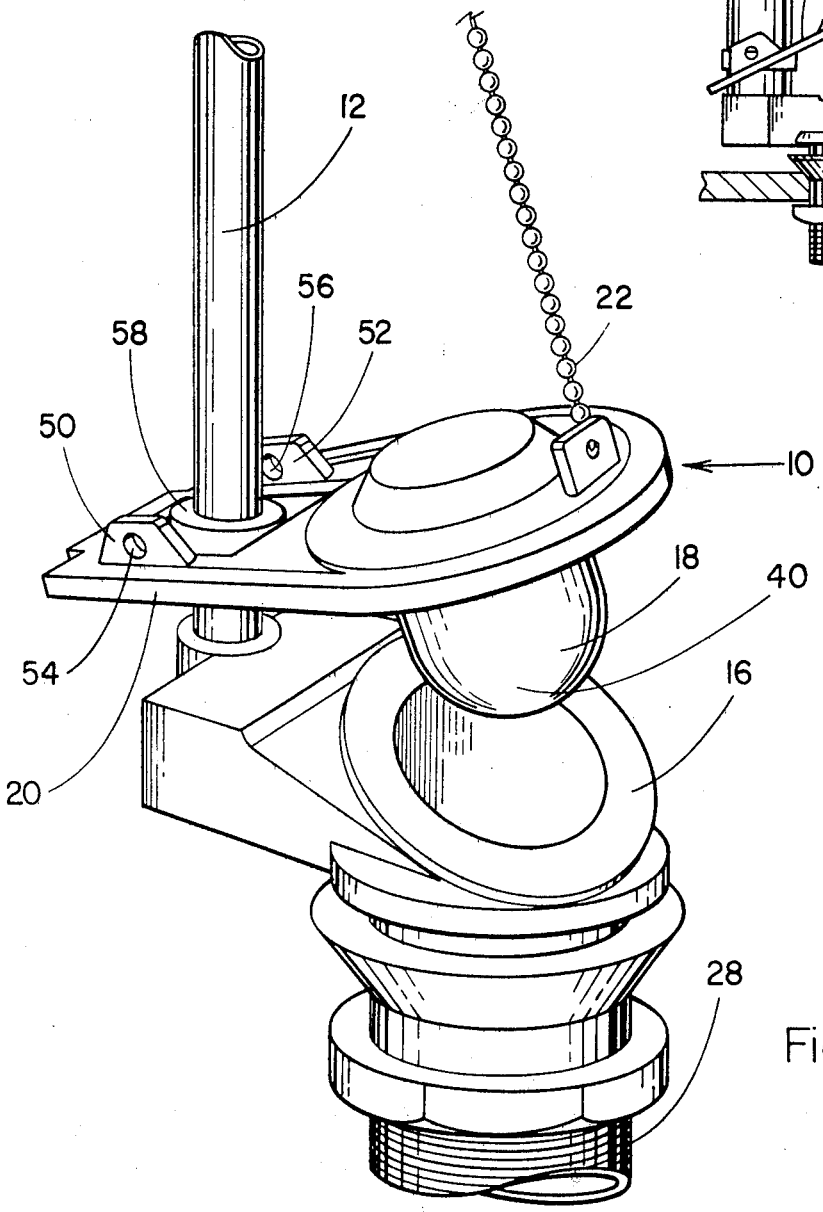
FIG. 2 is a view in perspective of the preferred discharge valve closure embodying the present invention.
Figure 3:
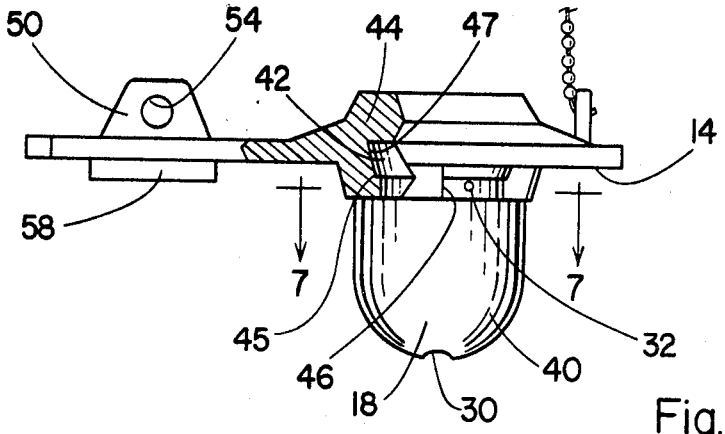
FIG. 3 is a view in side elevation of the embodiment illustrated in FIG. 2.
Figure 4:
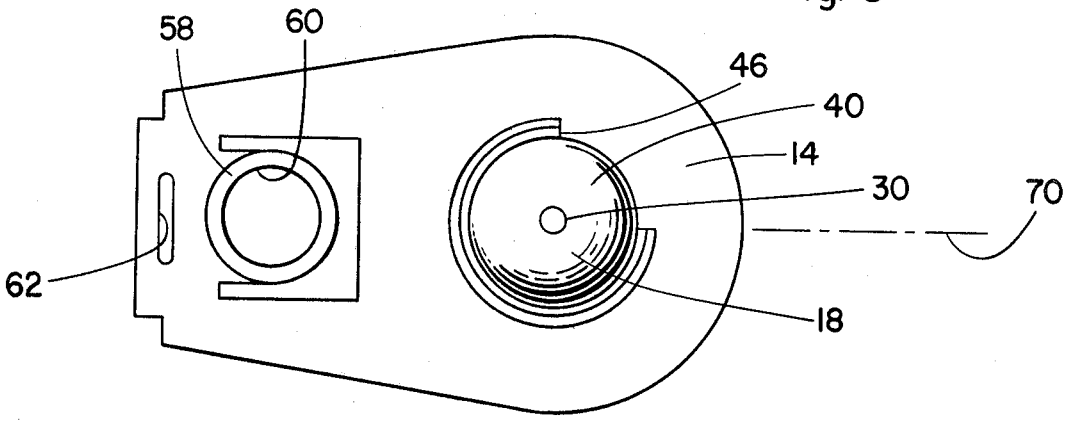
FIG. 4 is a bottom view of the embodiment of the invention illustrated in FIG. 2.

As illustrated in more detail in FIGS. 2, 3 and 4, the portion of the buoyancy chamber 18 which extends below the sealing portion 14 is a separate receptacle 40. Preferably, the separate receptacle 40 is a relatively rigid, plastic receptacle having the drain hole 30 formed at the bottom thereof and provided at the top with an outwardly extending annular flange 42. The underside of the remainder part 44 of the valve closure is provided with a mating shoulder 45 which may be a part of an inwardly opening annular groove 47 which receives the annular flange 42. This permits the separate receptacle part 40 to be pivoted or rotated within the remainder part 44 so that the bleeder hole 32 may be angularly positioned where desired. There may be a removed segment 46 removed from the annular shoulder. The removed segment is in an angular range centered about approximately 45° from the top dead center position of the bleeder hole illustrated in FIG. 1. Alternatively, the bleeder hole can be below the annular shoulder so that removal of a segment is unnecessary.

The preferred discharge valve closure utilizes a mounting arm member which is molded as a unitary part of the elastomeric portion of the closure. It includes a pair of upstanding ears 50 and 52 provided with holes 54 and 56 for attachment to oppositely outstanding arms when this type of structure is available in the tank. Additionally, it is provided with a collar 58 having a hole 60 for connection to the overflow pipe 12 where such connection is appropriate. This collar is cut off when the upstanding ears are used for mounting. Finally, it is also provided with a rearward slot 62 for connection to those tanks using such a mounting connection for the discharge valve closure.

The preferred embodiment may be adjusted to position the bleeder hole a desired angular distance from its top dead center position 70. Adjustment is accomplished by the trial and error system of positioning the bleeder hole and then observing the amount of water in the tank when the discharge valve closure falls closed. If the water level is lower than desired at the time the valve closes, then the bleeder hole should be rotated toward the top dead center position 70. However, if the water level is higher than desired, the bleeder hole is rotated away from the top dead center position.

For optimal operation, the bleeder hole should be located as nearly as possible to the interior ceiling of the buoyancy chamber so as to enable the escape of all air when the bleeder hole is adjusted to its top dead center position.

Figure 5:
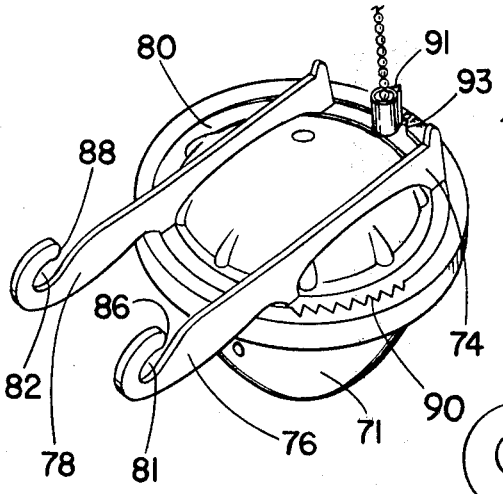
FIG. 5 is a view in perspective of an alternative embodiment of the invention.
Figure 6:
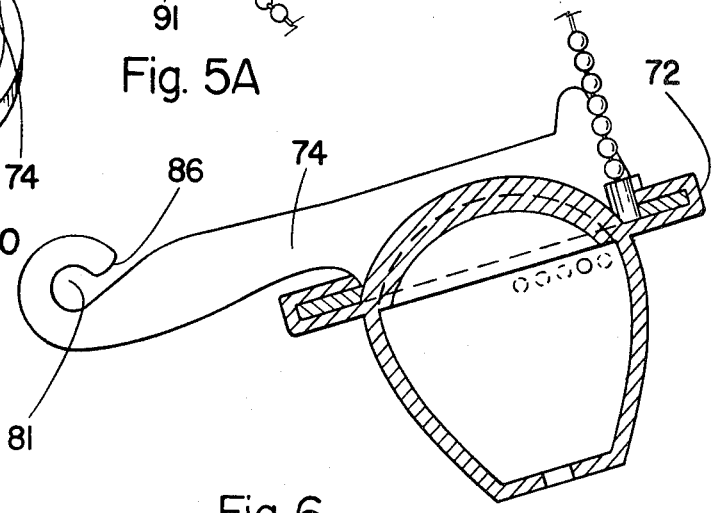
FIG. 6 is a view in side elevation of the embodiment of the invention illustrated in FIG. 5.

FIGS. 5 through 6 illustrate an alternative embodiment of the invention. The sealing portion and the buoyancy chamber portion of the closure are molded as a unitary body 71, preferably of conventional elastomeric material. The top of this unit is provided with an inwardly opening annular groove 72.

The closure also has a mounting arm member 74 having a pair of mounting arms 76 and 78 which are connected to an outwardly extending circular flange 80 which slideingly mates in the inwardly opening annular groove 72. This permits the entire sealing and buoyancy chamber unit to be rotated with respect to the mounting arm member 74.

Preferably the holes 81 and 82 formed in the mounting arm member 74 distally from the circular flange 80 are provided with a pair of tapered notches 86 and 88. This is because the material from which the mounting arm members are formed is preferably relatively rigid and the notches permit the outstanding mounting rods to be engaged within the holes by merely forcing the rods through the notches and into these holes, temporarily deforming the mounting arm member material in the region of the hole until the rods are pivotally within the holes.

Figure 5A:
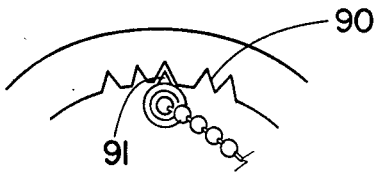
FIG. 5*a* is a view of a fragment of the embodiment of FIG. 5 illustrating the angle retaining means of the embodiment of FIG. 5.

As illustrated in FIG. 5*a*, preferably a plurality of notches 90 are formed along an angular segment of the upper centrally facing wall of the annular groove 72 of the sealing and buoyancy chamber unit. An outwardly extending keeper 91 protrudes from a portion of the circular flange 80 and releasably extends into one of the notches 90. This structure retains the selected relative angular position of the sealing and buoyancy chamber unit relative to the mounting arm member but permits it to be changed and adjusted because the material from which the notches are cut is elastomeric and therefore deformable.

The embodiment of FIGS. 5 and 6 is adjusted in essentially the same manner as accomplished in connection with the preferred embodiment. The bleeder hole may be adjusted to a variety of positions as illustrated in FIG. 6 by pivoting the entire sealing and buoyancy chamber unit 71 with respect to the mounting arm member 74 until the correct position is found by the trial and error method. Additionally, the entire sealing and buoyancy chamber unit may be pivoted so that the bleeder hole is positioned 180° opposite top dead center as illustrated in FIG. 5. In this position the discharge valve closure operates as a conventional discharge valve closure. Desirably an additional notch 93 is provided for retaining the unit in that position.

The theory of operation is that the adjustment of the bleeder hole to a more lateral position decreases the rate of buoyancy loss and thereby increases the length of time the closure remains open by decreasing the rate at which water enters the buoyancy chamber and also by trapping air within the portion of the buoyancy chamber which is above the adjusted position of the bleeder hole.

It has been found that by forming the lower drain hole of a diameter of approximately 0.1875 inches and the bleeder hole of approximately 0.1250 inches in discharge valve closures which are similar to conventional ones, the water level operation of most water tanks may typically be adjusted within the range of 60% of full flush tank capacity to 30% of tank capacity for maximum conservation.

Further theory is that the tank water level 34 at which the closure falls closed is dependent in part upon the volume of air which is in the buoyancy chamber above the bleeder hole. Therefore the level at which the closure closes is not linearly related to the adjustment angle of the bleeder hole from its top dead center position because the volume of space in the buoyancy chamber above the hole does not change linearly with the angular positioning. I find that adjustment of the angular position of the bleeder hole has little sensitivity in the upper position of the bleeder hole but the sensitivity increases as the angle increases. I find that as the angle approaches 90° the water level at which the valve closes changes in a very sensitive relationship to small changes in the angular position of the bleeder hole.

Figure 7:
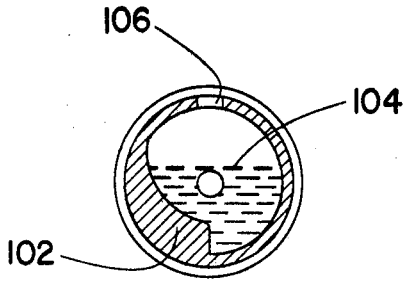
FIG. 7 is a view in horizontal section of the lower portion of the buoyancy chamber of the embodiment of FIG. 3 taken substantially along the line 7—7 of FIG. 3 but showing an alternative air and water displacement wall to modify the relationship between the angular adjustment and the rate of buoyancy change.

Therefore, FIG. 7 illustrates an alternative embodiment in which a displacement wall 102 is formed to define a compartment within the buoyancy chamber which cannot be occupied by air or water 104 during entry of water into the buoyancy chamber.

This displacement wall is tapered as illustrated so that the rate at which the volume above the bleeder hole 106 changes is closer to being linearly related to the annular position of the bleeder hole 106. Optimally, it is tapered so that there is as nearly a linear relationship as practicable between the angular position of the bleeder hole 106 and the water level 34 at which the valve falls closed.

Figure 8:
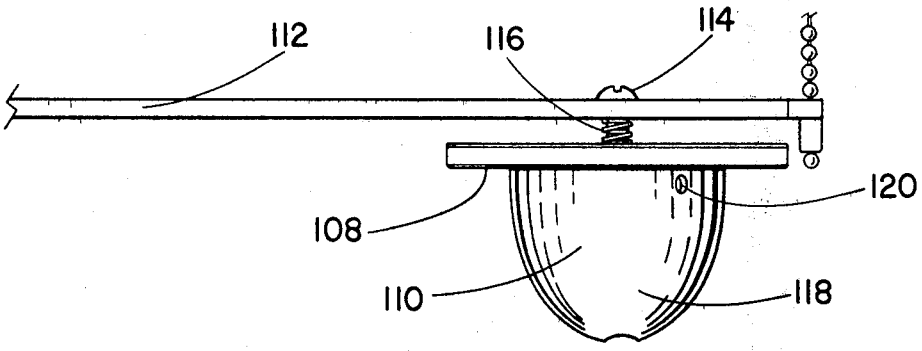
FIG. 8 is a view in side elevation of another alternative embodiment of the invention.

FIG. 8 illustrates yet another alternative embodiment of the invention in which the sealing portion 108 and the buoyancy chamber 110 are formed as a unitary body 118 somewhat similar to that of FIGS. 5 and 6. However, the unitary body 118 is connected to its associated mounting arm member 112 by means of a screw type fastener 114 having a spring 116 or other means to releasably retain the sealing and buoyancy unit 118 from rotation on its own.

However, by mounting the sealing and buoyancy chamber unit 118 with the single screw fastener 114, the angle of the bleeder hole 120 may be adjusted by manually rotating the unit 118.

Figure 9:
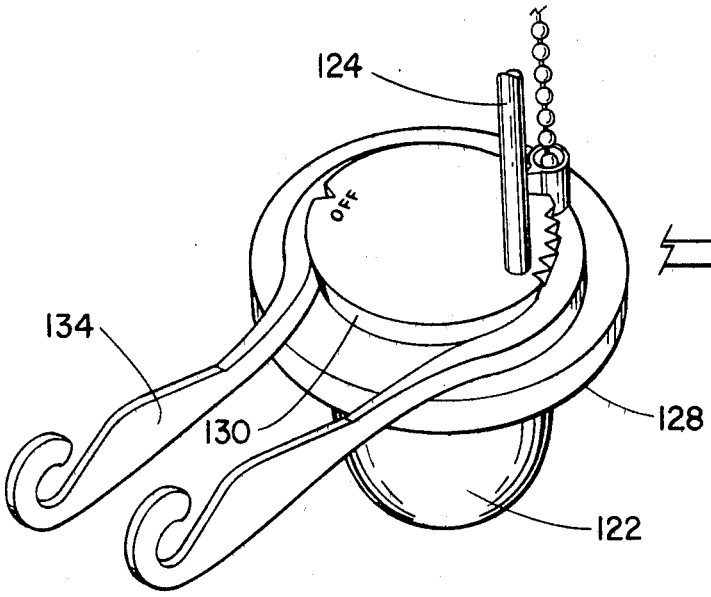
FIG. 9 is a view in side elevation of another alternative embodiment of the invention.

FIG. 9 illustrates yet another embodiment of the invention in which the bleeder port is formed on the upper end of the sealing and buoyancy chamber unit 122 and is connected by means of a snorkle tube 124 extending above the surface of the water. With the bleeder port positioned above the seal of the valve when the valve closure is closed against the valve seat, a snorkle must be provided to prevent the continuous drain of water into the bleeder port and out through the bottom drain hole. However, operation of this device is similar to that of the devices having the bleeder hole below the sealing portion 128.

The unitary sealing and buoyancy unit 122 of FIG. 9 is also pivotable for adjustment as described above. It is shown with an outwardly opening annular groove 130 formed above the sealing portion 128. A U-shaped mounting arm member 134 slidably clamps into the annular groove 130 and extends into pivotal connection to the tank in the conventional manner.

Figure 10:
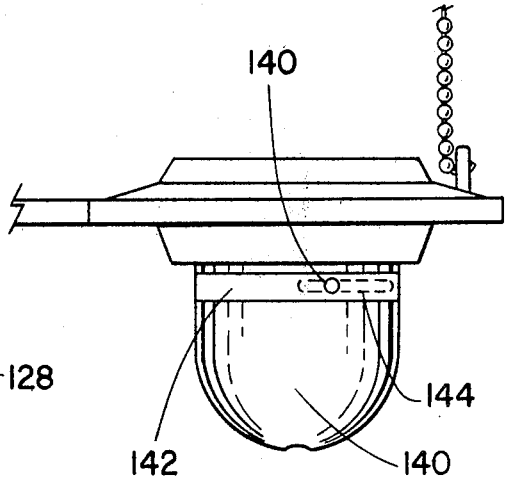
FIG. 10 is a view in side elevation of a portion of a buoyancy chamber illustrating an alternative embodiment of the invention.

FIG. 10 illustrates yet another alternative embodiment of the invention and shows merely the lower portion of the buoyancy chamber 140 which extends below the sealing region of the valve closure. The buoyancy chamber 140 is provided with an annular, rotatable wall 142, preferably in the form of a circular band which seats within a mating annular groove formed into the buoyancy chamber 140. The annular groove is provided with an elongated slot 144 opening into the interior of the buoyancy chamber 140. The bleeder hole 146 is provided in the rotatable wall 142 so that the entire band can be angularly pivoted within its groove to select the angular positioning of the bleeder hole 146.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

I claim:

1. An improved adjustable discharge valve closure of the type providing a selective water volume flush for the tank of a water closet, said discharge valve closure including a sealing portion and a buoyancy chamber portion attached to a mounting arm member at one end of said member, the other end of said member being pivotally attached to said tank for pivotal movement of the valve closure into and out of sealing engagement with the discharge valve seat, said buoyancy chamber portion, in the closed operable position of the valve closure, including a relatively lower drain hole and a relatively higher bleeder port formed through a wall of the buoyancy chamber portion said bleeder port being connected with gas at atmospheric pressure when said closure is in its closed position;

wherein the improvement permits manual adjustment of the water volume of a flush and comprises mounting at least the portion of the wall of the buoyancy chamber through which the bleeder port is formed for rotary movement about the center axis of the valve closure, which movement due to the pivotal movement of said mounting arm will vary the distance of said bleeder port from said tank bottom.

2. An improved adjustable discharge valve closure in accordance with claim 1 wherein said port is formed above the sealing portion of said closure and is connected to a snorkle extending above the water level in said tank.

3. An improved adjustable discharge valve closure in accordance with claim 1 wherein said port is a hole formed below the sealing portion of said closure.

4. An improved valve closure in accordance with claim 3 wherein a lower portion of said buoyancy chamber below said sealing portion is a separate receptacle part which is rotatably mounted to the remainder part of the valve closure and has said holes formed therein.

5. An improved valve closure in accordance with claim 4 wherein one of said parts has an annular flange and the other part has a mating shoulder for sealingly but rotatably mounting the receptacle part to the remainder part.

6. An improved valve closure in accordance with claim 5 wherein the shoulder or flange, whichever is formed on the remainder portion, has a segment removed to expose the upper bleeder hole, said removed segment being centered about approximately 45° from top dead center position of the bleeder hole.

7. An improved valve closure in accordance with claim 6 wherein said separate receptacle part is relatively more rigid than the remainder part.

8. An improved valve closure in accordance with claim 1 wherein said sealing portion and said buoyant chamber portion are rotatably mounted as a unit to said mounting arm member.

9. An improved valve closure in accordance with claim 8 wherein said mounting arm member is provided with a circular flange and said combined sealing and buoyancy chamber portions are provided with a mating annular groove for slidable receipt of said circular flange.

10. An improved valve closure in accordance with claim 9 wherein said mounting arm member comprises a pair of parallel arms extending from said circular flange and having a pair of opposed holes distally from the flange for pivotal attachment to the tank and also having a pair of tapered notches opening to said holes.

11. An improved valve closure in accordance with claim 9 wherein a retaining means is provided for retaining the relative angular position of said sealing and buoyancy chamber unit relative to said mounting arm, said retaining means comprising a protruding keeper formed on either said mounting arm or said unit but not both and a plurality of notches formed in the other for releasably receiving said keeper.

12. An improved valve closure in accordance with claim 1 wherein a displacement wall is formed within said buoyancy chamber portion to define a tapered compartment which restricts the amount of air or water contained within said buoyancy chamber.

13. An improved valve closure in accordance with claim 1 wherein an annular groove is formed into one surface of the wall of said buoyancy chamber portion and has a slot cut through to the other surface, and wherein a circular band having a hole therethrough to form said bleeder port is rotatably, matingly and slidably seated in said groove.

14. An improved valve closure in accordance with claim 1 wherein an outwardly opening annular groove is formed on said closure above said sealing portion and a U-shaped mounting arm member is engaged around said groove.

15. An improved valve closure in accordance with claim 1 wherein said sealing portion and said buoyancy chamber portion are formed as a unitary body which is rotatably mounted to a mounting arm member by a central fastener and wherein a releasable retaining means is provided to releasably secure the unitary body in a selected angular position of the bleeder port.

* * * * *